US007651088B2

(12) United States Patent
Stenzel et al.

(10) Patent No.: US 7,651,088 B2
(45) Date of Patent: Jan. 26, 2010

(54) SYSTEM, METHOD, AND PROGRAM FOR STACKING MULTI-THICKNESS SHEETS OF MEDIA

(75) Inventors: James G Stenzel, Rochester, NY (US); Vincent Berardi, Webster, NY (US); Cesar R Marquez, Madison, WI (US); Edward P Imes, Ontario, NY (US); Ronald M Edsall, Fairport, NY (US); Warren Brady, Rochester, NY (US); Liam Cummings, Macedon, NY (US); Norman Vanas, Rochester, NY (US); Christopher Delano, Webster, NY (US); Michael Cook, Waterloo, NY (US)

(73) Assignee: Xerox Corporation, Norwalk, CT (US)

( * ) Notice: Subject to any disclaimer, the term of this patent is extended or adjusted under 35 U.S.C. 154(b) by 532 days.

(21) Appl. No.: 11/214,911

(22) Filed: Aug. 31, 2005

(65) Prior Publication Data

US 2007/0045940 A1 Mar. 1, 2007

(51) Int. Cl.
*B65H 29/00* (2006.01)

(52) U.S. Cl. ..... 271/184; 271/185

(58) Field of Classification Search ..... 271/184, 271/185, 176, 207, 186; 414/791.5, 791.2, 414/792; 53/446, 544

See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 3,970,202 | A * | 7/1976 | Speggiorin et al. | 414/788.3 |
| 4,307,800 | A * | 12/1981 | Joa | 198/374 |
| 4,364,702 | A * | 12/1982 | Coussot | 414/788.3 |
| 4,657,465 | A * | 4/1987 | Aoki | 414/788.3 |
| 5,364,087 | A * | 11/1994 | Schieck et al. | 271/148 |
| 6,179,548 | B1 * | 1/2001 | Lukes et al. | 414/791 |
| 6,572,575 | B1 * | 6/2003 | Shimada et al. | 604/385.01 |
| 2003/0023215 | A1 * | 1/2003 | Baker | 604/368 |
| 2003/0114814 | A1 * | 6/2003 | Baker et al. | 604/368 |
| 2003/0196413 | A1 * | 10/2003 | Schapiro | 53/449 |

FOREIGN PATENT DOCUMENTS

| | | | |
|---|---|---|---|
| JP | 6-107368 | * | 4/1994 |

* cited by examiner

*Primary Examiner*—Patrick H Mackey
*Assistant Examiner*—Thomas A Morrison
(74) *Attorney, Agent, or Firm*—Oliff & Berridge, PLC

(57) ABSTRACT

Systems, methods, and programs for adjusting an output orientation of multi-thickness media input marking data, determine a number of sheets of the multi-thickness media that is to be alternated within an output stack, and adjust the output orientation of at least one sheet of multi-thickness media to be output based on the determined number of sheets of the multi-thickness media to be alternated.

18 Claims, 8 Drawing Sheets

SYSTEM, METHOD, AND PROGRAM FOR STACKING MULTI-THICKNESS SHEETS OF MEDIA

BACKGROUND

1. Related Technical Fields

Related technical fields include systems, methods, and programs for alternating sheets of media.

2. Background Art

Many conventional marking devices are configured to obtain optimized results with standard sizes of sheets of media such as, for example, letter sized media (8.5" by 11"), A4 media, executive sized media, A5 media, legal sized media, envelopes, and the like. Specifically, for example, the media storage, media transport, and marking functions of these conventional marking devices are designed around these common media sizes such that these sizes of media can be most efficiently used within the devices. Accordingly, special steps and/or user-assisted functions may be required for uniquely sized media.

Such marking devices typically include one or more input modules, each of which may include one or more feeders, into which blank media is loaded for imaging. Conventional feeders are usually adjustable for media size, and generally feed from the top of the stack of media. The feeder generally includes an elevator on which the stack of media is loaded, and which rises as media is fed off the top of the stack reducing the stack height. Thereby, the stack is kept level with the feeding mechanism.

The primary function of the feeder is to advance media to the imaging process one sheet at a time, at very precise intervals, as dictated by the marking device process.

Conventional marking devices typically include one or more output modules, performing various post imaging operations. Typically, the last output module in the imaging and finishing process is a stacker, where consecutive pages or sets of pages are automatically stacked one on top of the previous, as part of the real-time imaging and finishing process.

Some types of combined media for use in these conventional marking devices incorporate a smaller, uniquely sized, sheet of media fixed to at least a portion of a larger, standard sized, sheet of media. These types of media enable marking on the smaller, uniquely sized, sheet of media while utilizing the efficiently stored and transported, standard sized, sheet of media as a vehicle through the marking device. As a result, fewer special steps and/or user-assisted functions are required for marking on the smaller, uniquely sized, sheet of media.

Conventional marking devices that are optimized for standard sized media are designed to begin marking on a leading portion of the sheet of media as it is transported through the device. As a result, the smaller, uniquely sized, sheet of media is frequently fixed to the leading edge of the larger, standard sized, sheet of media. This allows for marking to begin on the leading portion of the combined media.

SUMMARY

The above-described, conventional combined media, as result of having a smaller sheet of media fixed to a leading portion (in the vicinity of the leading edge of the combined media) of the larger sheet of media has a thicker leading portion than trailing portion (in the vicinity of the trailing edge of the combined media). Thus, the leading portion has a thickness equivalent to the thickness of both the small sheet and the large sheet while the trailing portion has a thickness equal to only the large sheet.

As used herein the term "leading edge" is intended to describe the edge of a sheet of media that leads the sheet of media as it is transported through a marking device. Similarly, the term "trailing edge" is intended to describe the edge of a sheet of media that is opposite the leading edge and trails the sheet of media as it is transported through the marking device. As used herein, the terms "feeder" or "media feed mechanism" are intended to describe devices that feed unmarked media into a marking device. The terms "stacker" or "media stacking mechanism" are intended to describe devices that stack marked media after being marked by the marking device. It should be appreciated that the feeder and/or stacker may be included in the marking device or may be separate devices attached to the marking device.

One example of the above-described combined, multi-thickness, media is Xerox Corporation's DocuCard® media. For ease of explanation, the following exemplary systems, method and, programs will be disclosed using DocuCard® type media as an example of combined, multi-thickness, media; however, it should be appreciated that the principles disclosed herein may be applied to any type of media with each sheet having at least two different thicknesses.

Conventional media stackers are designed such that media will not remained stacked if stacked media becomes non-level with the stacking surface.

Conventionally, however, the above-described combined, multi-thickness, media is packaged and loaded into the feeder of marking devices with each sheet having the same orientation. Because each sheet has a same orientation, the marking device may process each sheet in the same manner, thus simplifying the marking process. Due to the orientation of the sheets, the thicker portion of each sheet of the combined media is oriented above the thicker portion of the sheets below it and the thinner portion of each sheet of the combined media is oriented above the thinner portion of the sheets below it.

As a result, when the combined multi-thickness media has been marked, transported through the marking device, and stacked in the stacker, the stack of output media becomes increasingly non-level due to the difference in thickness between a portion of the stack corresponding to the thick portion of the media and a portion of the stack corresponding to the thin portion of the media. As the number of output sheets of combined multi-thickness media increases, the more non-level the stack becomes. Eventually, the slope is great enough that the down-slope gravitational pull on the sheet exceeds the friction between sheets, and the sheets start to slip off of the stack. Additionally, the slope of the output stack may cause subsequently output sheets to collide and jam.

Currently, in order to avoid jams or misfeeds in conventional general purpose marking devices, users must limit the number of sheets of multi-thickness media that are loaded into a media tray in order to reduce the overall thickness difference between a leading edge portion of the stack and the trailing edge portion of the stack both input and output.

Currently, the stacker must be unloaded more frequently, at lower than maximum possible stack height in order to avoid sheets from falling off the stack and/or jams.

In view of at least the forgoing, it is beneficial to provide systems, methods, and programs that allow for a large number of sheets of combined multi-thickness media to be loaded in the feeder of a general purpose marking device and stacked in the stacker of a general purpose marking device, without substantial expense and hardware modification.

Accordingly, various exemplary implementations of the principles described herein provide a method of adjusting an output orientation of multi-thickness media including inputting marking data, determining a number of sheets of the multi-thickness media that is to be alternated within an output stack, and adjusting the output orientation of at least one sheet of multi-thickness media to be output based on the determined number of sheets of the multi-thickness media to be alternated.

Various exemplary implementations of the principles described herein provide a storage medium storing a set of program instructions executable on a data processing device and usable to adjust an output orientation of multi-thickness media, the instructions including instructions for inputting marking data, instructions for determining a number of sheets of the multi-thickness media that is to be alternated within an output stack, and instructions for adjusting the output orientation of at least one sheet of multi-thickness media to be output based on the determined number of sheets of the multi-thickness media to be alternated.

Various exemplary implementations of the principles described herein provide a system for adjusting marking data for use with alternately stacked multi-thickness media, including a controller. The controller may input marking data, determine a number of sheets of the multi-thickness media that is to be alternated within an output stack, and adjust the output orientation of at least one sheet of multi-thickness media to be output based on the determined number of sheets of the multi-thickness media to be alternated.

BRIEF DESCRIPTION OF THE DRAWINGS

Exemplary implementations will now be described with reference to the accompanying drawings, wherein.

DETAILED DESCRIPTION OF EXEMPLARY IMPLEMENTATIONS

Figure 1:
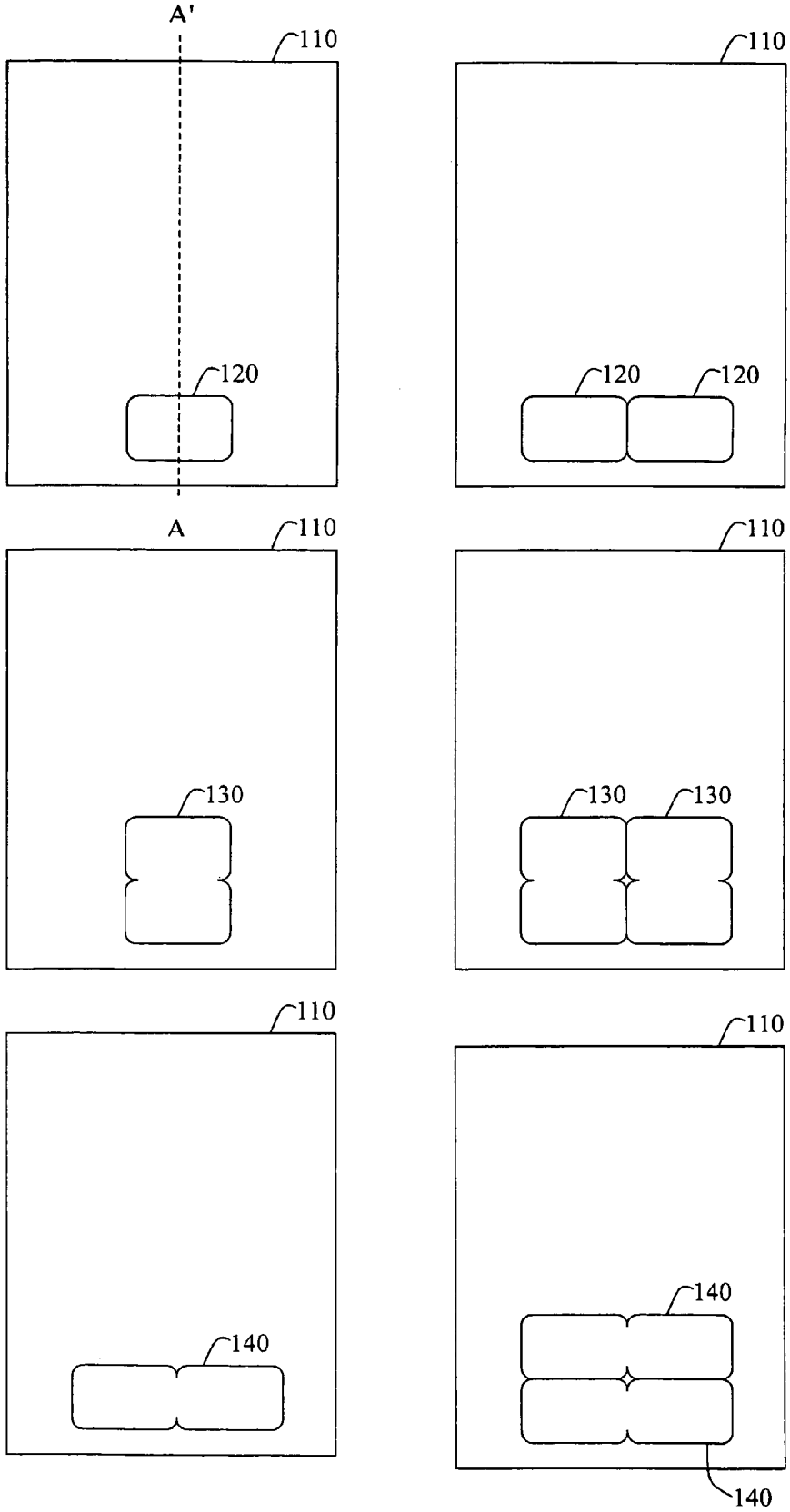
FIG. 1 shows exemplary configurations of multi-thickness media in plan view.

FIG. 1 shows some exemplary configurations of the above-described combined, multi-thickness media. The media may include a standard-sized large sheet of media 110 (hereinafter the "large media") and at least one of a small media 120 for single-side printing, a small media 130 which may be folded along a long axis to approximate double-side printing, and/or a small media 140 which may be folded along a short axis to approximate double-side printing.

Figure 2:
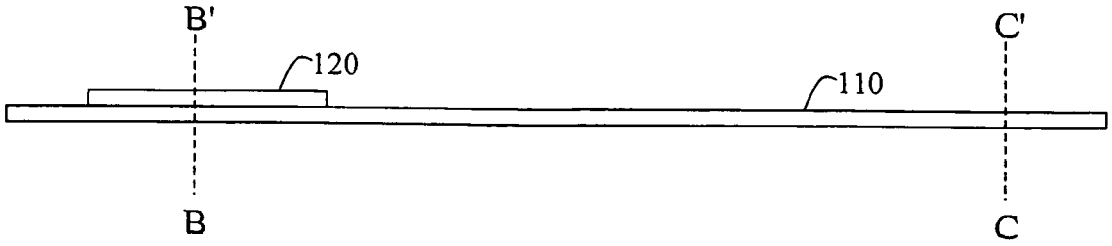
FIG. 2 shows an exemplary configuration of multi-thickness media in cross-section.

FIG. 2 shows an exemplary configuration of multi-thickness media in cross-section. Specifically, FIG. 2 shows a cross-section through line A-A' in FIG. 1, of a combined multi-thickness media including a large sheet of media 110 and a small media 120 for single side printing. As shown in FIG. 2, the combined multi-thickness media is thicker, in a direction of line B-B', in a portion corresponding to the small media 120. The combined multi-thickness media is thinner, in a direction C-C', in a portion corresponding to only the large media 110.

Figure 3:
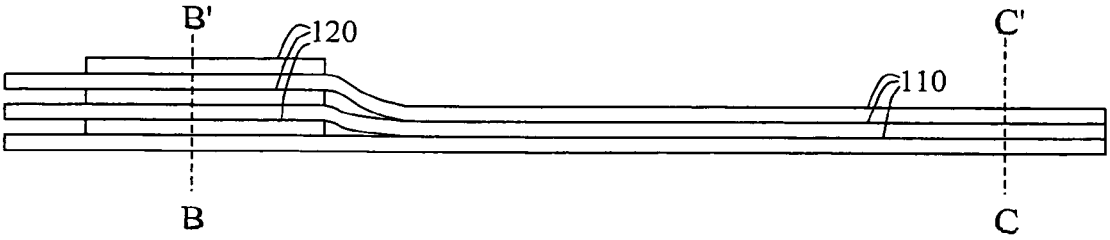
FIG. 3 shows a conventional stacking arrangement of multi-thickness media in cross-section.
Figure 4:
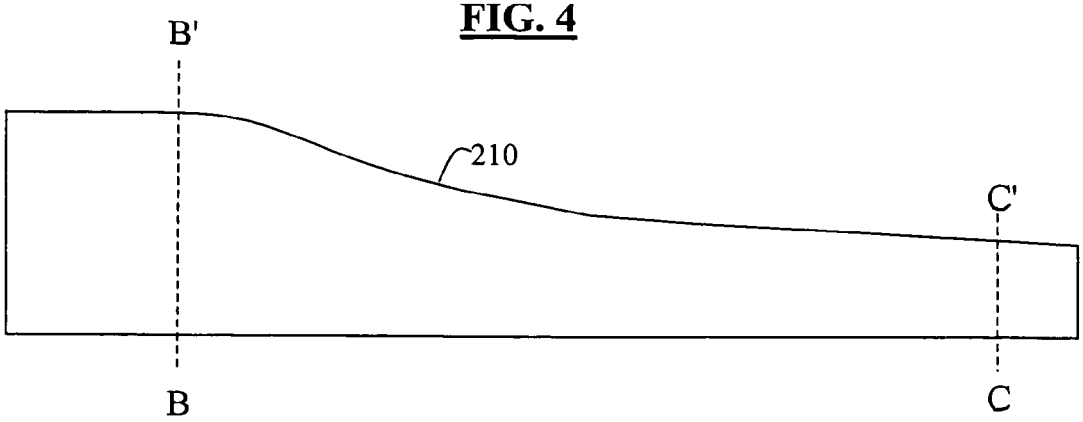
FIG. 4 shows a cross-sectional profile of a conventional stack of a large number of sheets of multi-thickness media.

FIG. 3 shows a plurality of the combined multi-thickness media stacked in a conventional manner. As discussed above, combined multi-thickness media are conventionally stacked in a same orientation in order to simplify the marking process. Thus, as shown in FIG. 3, each sheet is aligned in a stack with a portion corresponding to the small media 120 stacked above a portion corresponding to the small media 120 of the sheet below it. The thicker portion of each sheet is stacked on a thicker portion of each sheet below it. Thus, a portion of the entire stack corresponding to the small media 120 (e.g., in the vicinity of line B-B') is substantially thicker than a portion corresponding to only the large media 110 (e.g., in the vicinity of line C-C'). An example of the resultant shape of a large stack of combined multi-thickness media is shown in FIG. 4.

The difference in thickness between a portion of the stack corresponding to the small media 120 and a portion corresponding only to the large media 110 can cause a number of problems when attempting to load a plurality of sheets into a marking device or stack a plurality of marked sheets output from a marking device. For example, by virtue of the slope created by the difference in thickness, sheets on the top of the stack have a tendency to slide off the top of the stack. Additionally, by virtue of the slope created by the difference in thickness, sheets on the thicker end of the stack have a tendency to separate, or fan out, as a result of the slope and the stiffness of the media.

The slope and separation makes it difficult for a conventional media transport system to stack marked sheets output from a marking device.

Figure 5:
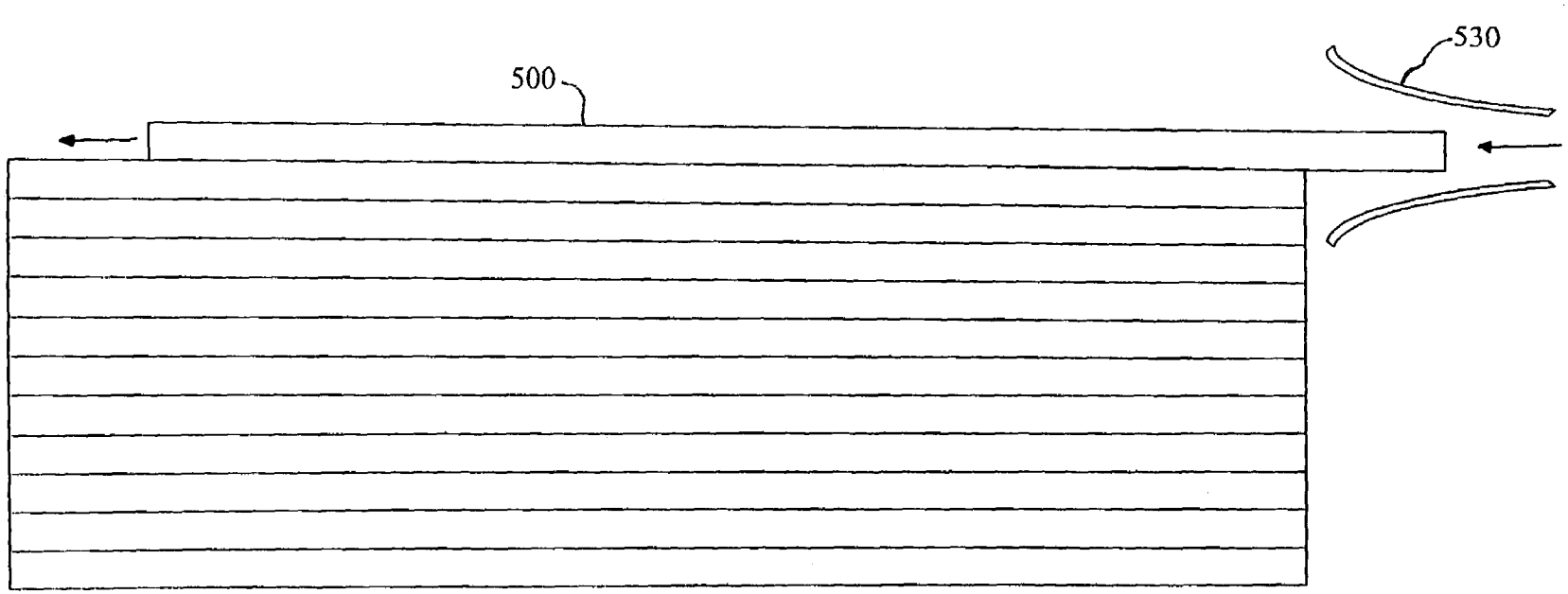
FIG. 5 shows a cross-sectional profile of a conventional stack of sheets of constant thickness media.

For example, as shown in FIG. 5, when sheets of constant-thickness media 500, are output in a stacker, the stack has a substantially constant thickness as well. When an output chute 530 of the media transport path outputs a marked sheet of constant-thickness media 500, the output sheets 500 form a substantially even stack.

Figure 6:
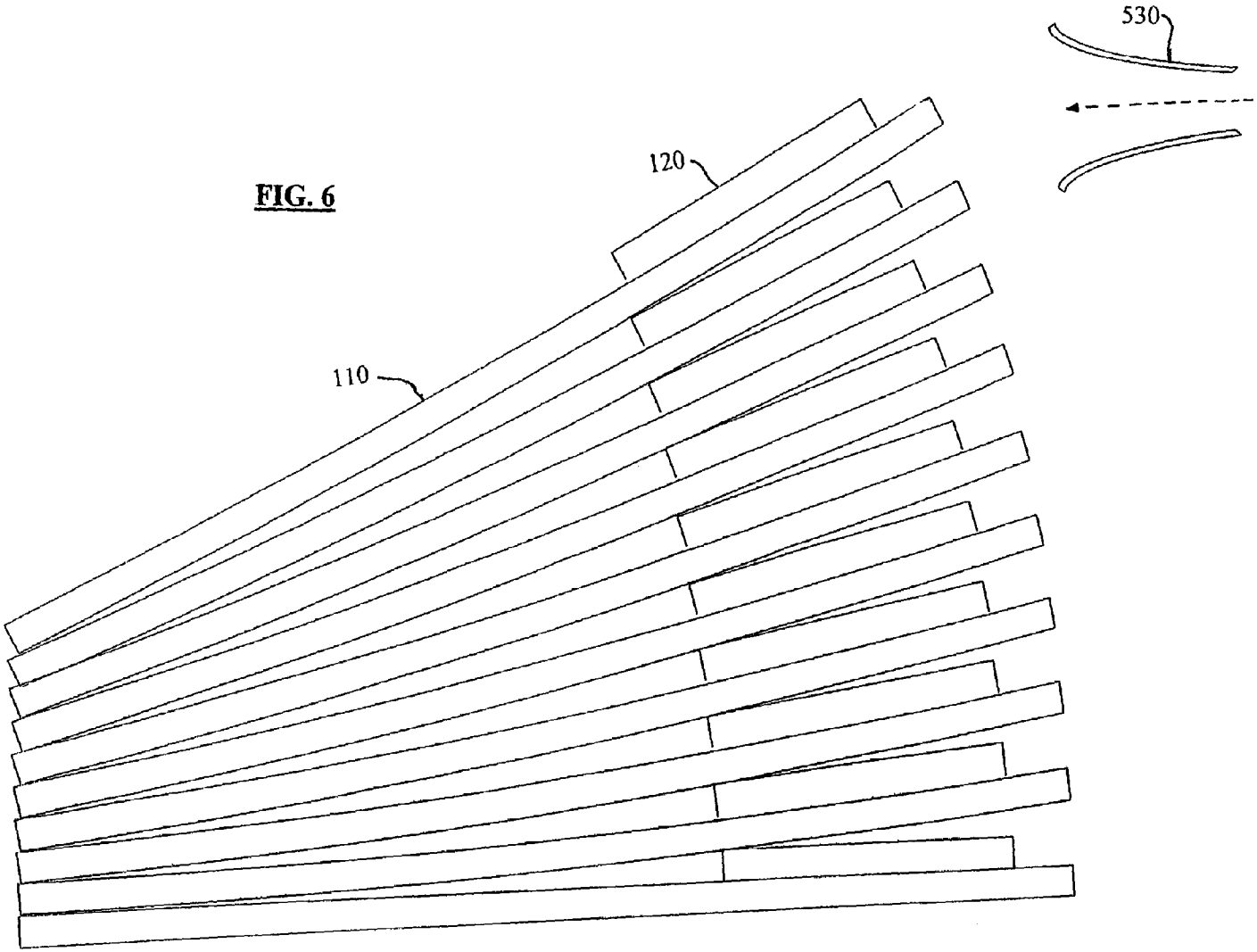
FIG. 6 shows a cross-sectional profile of a conventional stack of sheets of multi-thickness media.

However, as shown in FIG. 6, when sheets of multi thickness media, including, for example, large media portion 110 and small media portion 120, are output in a stacker in a conventional manner, the difference in thickness between a portion of the stack corresponding to the small media 120 and a portion of the stack corresponding to only the large media 110 causes the output stack to slope away from the output chute 530. As a result, the output stack has an angle of incidence substantially corresponding to the slope of the stack. As the height of the stack increases, the angle of incidence increases and thus the greater the separation or fanning of the sheets. This angle of incidence may cause the sheets to slide off of the stack. Additionally, this angle of incidence may cause subsequently output sheets (output in a direction of the dashed arrow in FIG. 6) to collide with the separated or fanned sheets possibly knocking sheets off of the top of the stack or causing a jam within the media transport path.

In order to reduce the likelihood that a jam, misfeed, or stack collapse may result due to the stacking of the combined multi-thickness media, many users of marking devices have reduced the number of combined multi-thickness media that are stacked in the marking device at any one time. This requires a user to more closely monitor the number of combined multi-thickness media in the device and more frequently replenish the combined multi-thickness media or to unload the stacker.

Figure 7:
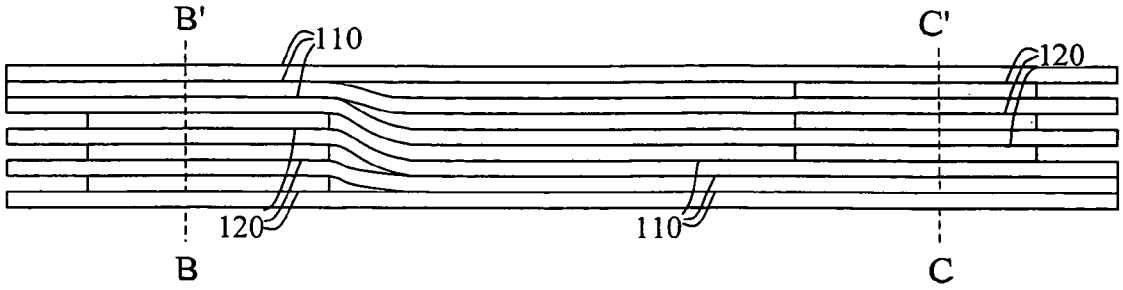
FIG. 7 shows stacked sheets of multi-thickness media in cross-section according to an exemplary implementation of the principles described herein.

Accordingly, it is beneficial to provide systems, methods, and programs that allow for a large number of sheets of combined multi-thickness media to be stacked in the feeder of a general purpose marking device, and for these sheets to be reliably stacked in the stacker after being marked. FIG. 7 shows an example of a method of stacking combined multi-thickness media that substantially reduces the unevenness of the stack. As shown in FIG. 7, the orientation of output marked sheets may be adjusted such that a first amount of the output combined multi-thickness media may be stacked in a same orientation with the thicker portion of each sheet stacked on a thicker portion of each sheet below it. Then, a second amount, for example, having a substantially similar number of sheets as the first portion, may be stacked on the first amount in an orientation such that a thicker portion of the second amount of combined multi-thickness media may be stacked on the thinner portion of the first amount. Additional amounts of combined multi-thickness media may be stacked in the same alternating fashion.

As a result of the configuration shown in FIG. 7, some of the sheets combined multi-thickness media will have the small media 120 in the vicinity of the leading edge of the large media 110 and some of the sheets of combined multi-thickness media will have the small media in a vicinity of the trailing edge of the sheet of media. When taken together, as shown in FIG. 8, a stack including a large number of sheets may have a substantially similar thickness in the vicinity of the small media 120 since the small media is located in both the leading edge and trailing edge portions of the stack.

Figure 9:
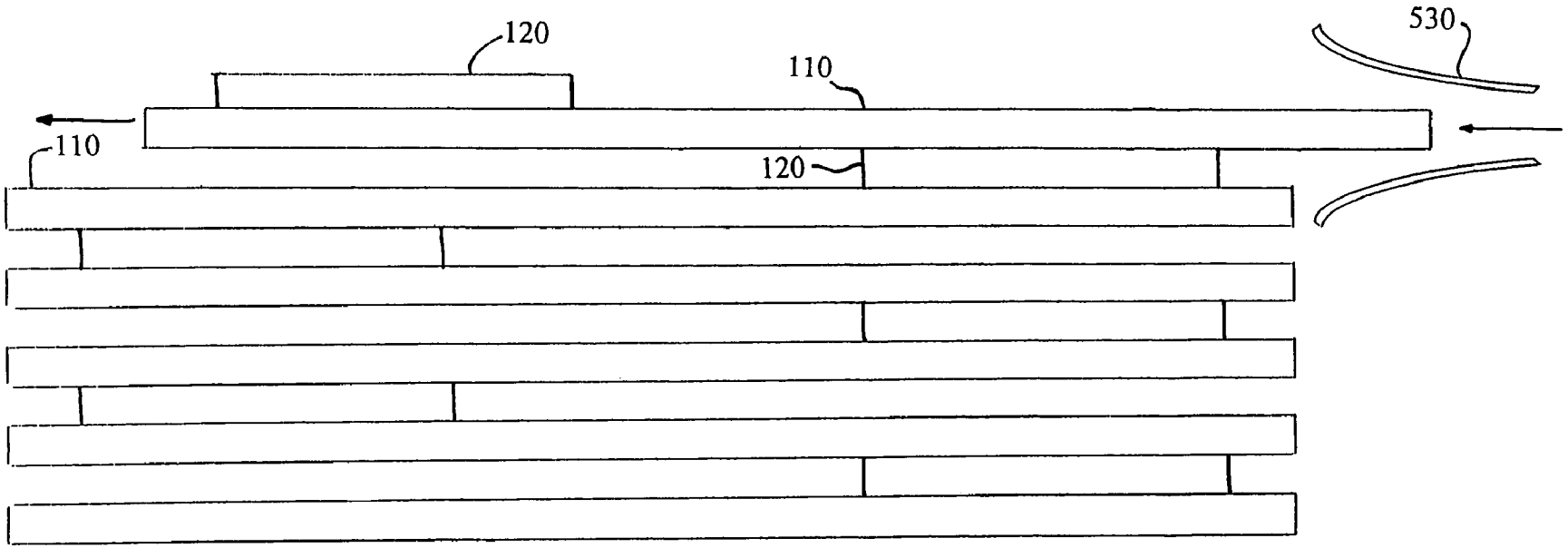
FIG. 9 shows a cross-sectional profile of a stack of sheets of multi-thickness media in a stacker, stacked according to an exemplary implementation of the principles described herein.

By stacking the sheets of output combined multi-thickness media in such a manner, the angle of incidence of the output sheets is substantially horizontal. As shown in FIG. 9, when sheets of combined multi-thickness media are output from the output chute 530, the output stack is properly aligned with a direction of transport from the feed chute 530. Thereby reducing the likelihood of a misfeed and/or jam.

As discussed above, combined multi-thickness media is conventionally stacked in a same orientation (e.g., as shown in FIGS. 3 and 4) in order to simplify the marking process and transport process. When conventionally stacked combined multi-thickness media is transported through the marking device, the small media 120 is always in the same location relative to the marking device so that the image device does not need to adjust the position of the marked image with respect to the sheet of combined multi-thickness media. The marked sheets of combined multi-thickness media are then output from the marking device and stacked with a same orientation.

Figure 8:
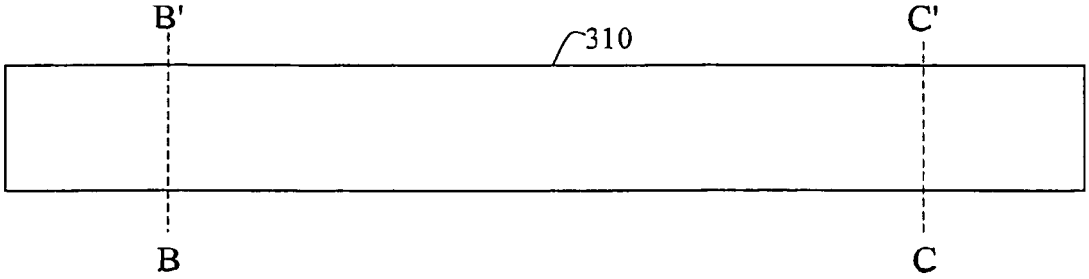
FIG. 8 shows a cross-sectional profile of a stack of a large number of sheets of multi-thickness media according to an exemplary implementation of the principles described herein.

According to the stacking method shown in FIGS. 7-9, the location of the small media 120 relative to the stack is not the same.

Figure 10:
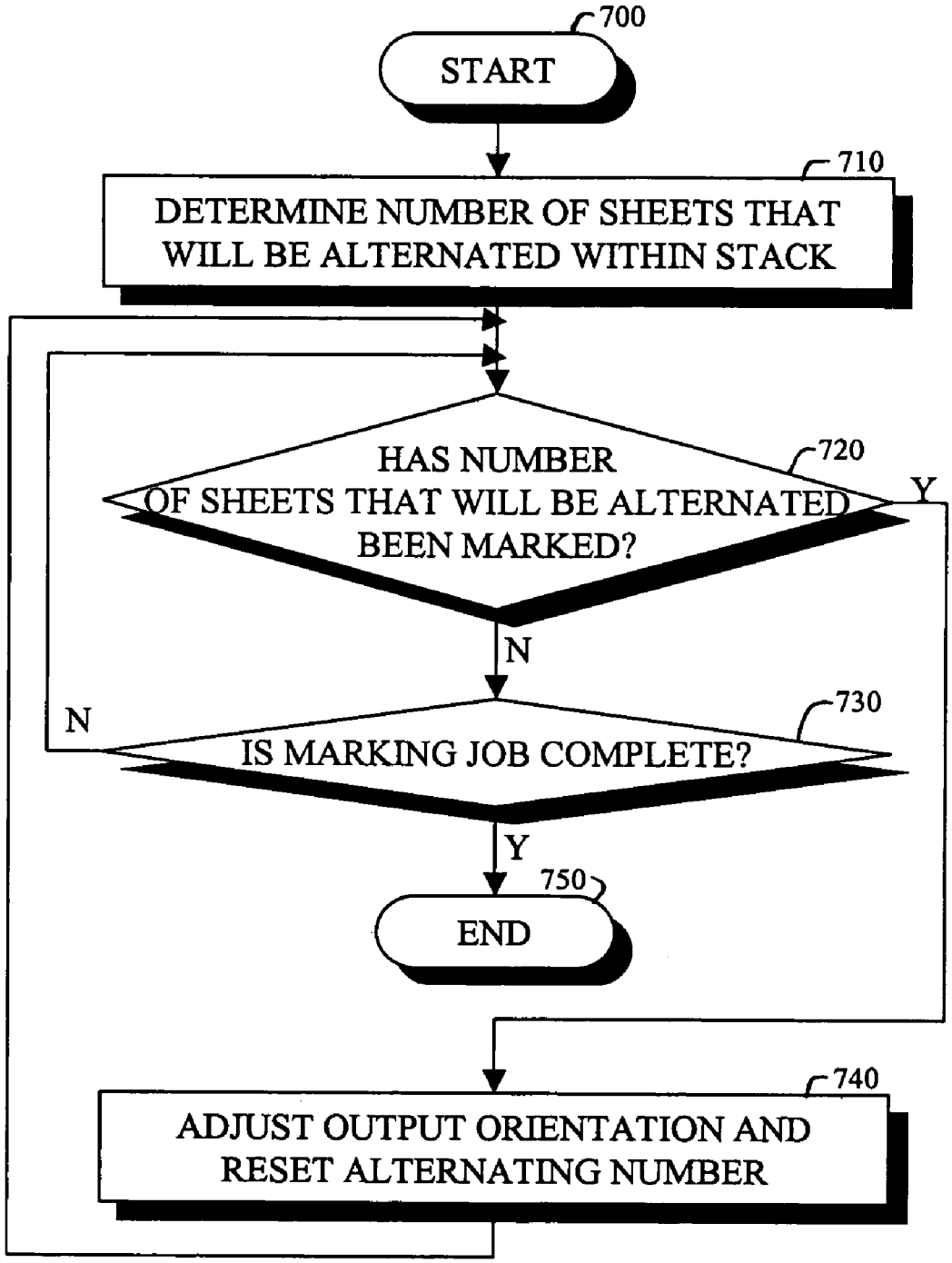
FIG. 10 shows a method of processing multi-thickness media according to an exemplary implementation of the principles described herein.

FIG. 10 shows an exemplary method of transporting combined multi-thickness media for use with combined multi-thickness media stacked in an alternating fashion. As shown in FIG. 10, the method begins in step 700 and continues to step 710 where it is determined how many sheets will be alternated within the stack. For example, five sheets may be alternated within the stack wherein the first 5 sheets have the small media 120 located in the vicinity of the leading edge of the combined multi-thickness media and the second five sheets have the small media 120 located in the vicinity of the trailing edge of the combined multi-thickness media.

The number of sheets that will be alternated may be determined in any number of ways. For example, the number of sheets that will be alternated may be defined by a user of the marking device. Accordingly, the user may input the number of sheets that will be alternated into the device. The number of sheets that will be alternated may be predetermined and stored within the device or a program/controller controlling the device. The number of sheets that will be alternated may be automatically determined based on one or more the characteristics of the corresponding marking operation.

Operation continues to step 720. In step 720, it is determined whether the number of sheets that will be alternated has been marked and output to the stacker. For example, a counter or sensor may keep track of the number of sheets that are marked on or transported past the sensor. If the number of sheets that will be alternated has not been marked and output to the stacker, operation continues to step 730. If the number of sheets that will be alternated has been marked and output to the stacker, operation jumps to step 740.

In step 730, it is determined whether the making job is complete, i.e., whether all sheets of media that are to be marked according to the marking operation have been marked. If the marking operation is complete, operation jumps to step 750 where operation of the exemplary method ends. If the marking operation is not complete, operation returns to step 720.

In step 740, the output orientation of the sheets to be output is adjusted and the alternating number is reset. For example, assume that five sheets are to be alternated within the output stack. Once the fifth sheet is marked on (e.g., determined in step 720) the orientation of the next sheet to be output is adjusted such that the next sheet may be stacked on the first five output sheets in an orientation such that a thicker portion of the next sheet may be stacked on the thinner portions of the first five sheets. It should be appreciated that the output orientation may be adjusted within the media transport path, either before or after marking by flipping the sheet upside down, or by maintaining the sheet right-side-up and rotating the sheet such that the leading edge becomes the trailing edge. Operation returns to step 720.

It should be further appreciated that any number of sheets of combined multi-thickness media may make up the groups of sheets whose orientation are alternated within the stack. For example, as much as substantially half of the entire job may be alternated. Additionally, each single sheet may be alternated. If a small number of sheets are alternated the stack will remain more uniform in thickness as marking operations increase the number of sheets in the stack. If a larger number of sheets are alternated, the position and/or orientation of the marked image relative to the sheet of combined multi-thickness media will be changed less frequently.

Figure 11:
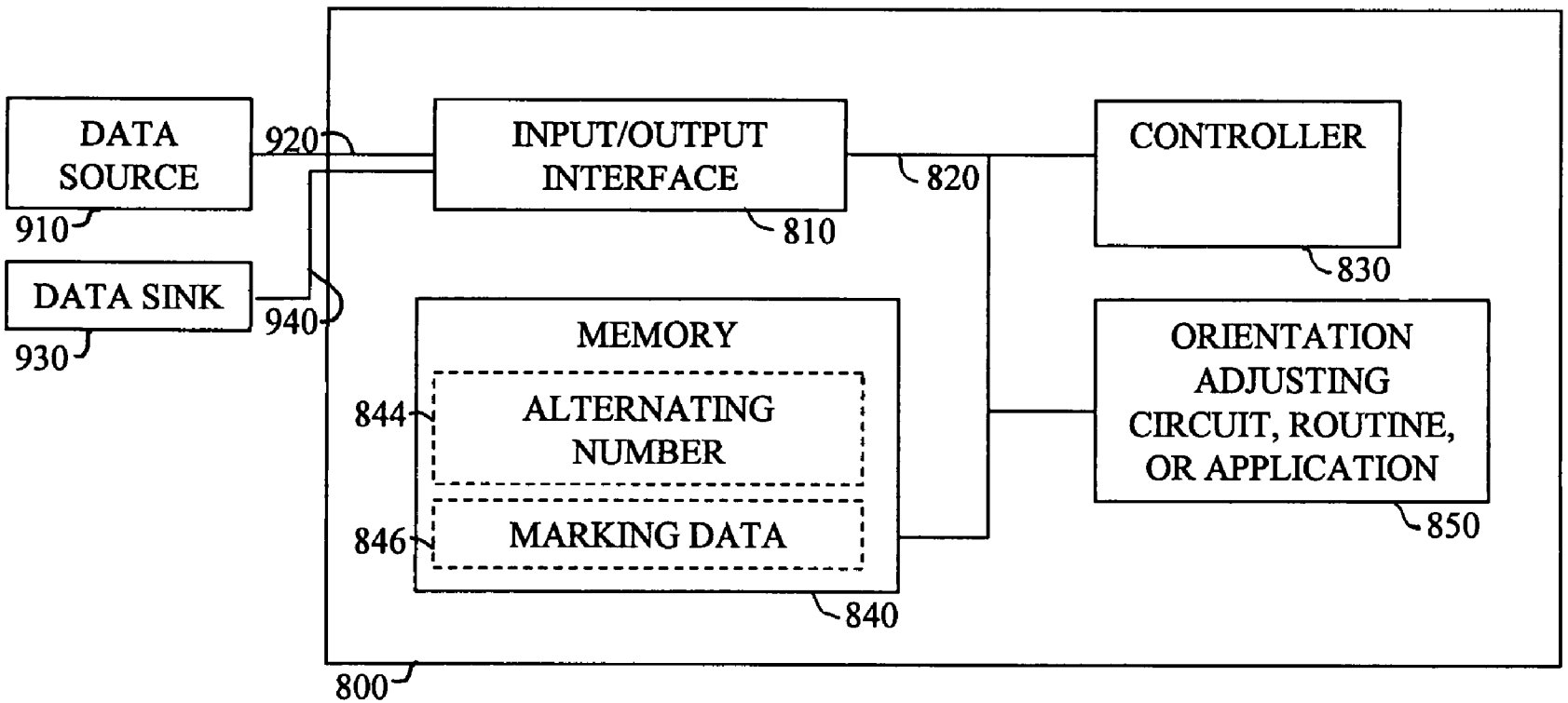
FIG. 11 shows a system for processing multi-thickness media during marking according to an exemplary implementation of the principles described herein.

FIG. 11 shows a functional block diagram of an exemplary system 800 for processing multi-thickness media during marking. As shown in FIG. 11, the system 800 may be physically, functionally, and/or conceptually divided into an input/output interface 810, a controller 830, a memory 840, and/or an orientation adjusting circuit, routine, or application 850, each appropriately interconnected by one or more data/control busses and/or application programming interfaces 820, or the like.

The input/output interface 810 may be connected to one or more data sources 910 over one or more links 920. The data source(s) 910 can be a locally or remotely located computer, a printer, a scanner, a facsimile device, a xerographic device, a multi-functional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data source 910 can be any known or later-developed source that is capable of providing image data to the input/output interface 810.

The input/output interface 810 may be connected to one or more data sinks 930 over one or more links 940. The data sink(s) 930 can be a locally or remotely located inkjet printer, locally or remotely located laser printer, a facsimile device, a xerographic device, a multi-functional imaging device, a device that stores and/or transmits electronic data, such as a client or a server of a wired or wireless network, such as for example, an intranet, an extranet, a local area network, a wide area network, a storage area network, the Internet (especially the World Wide Web), and the like. In general, the data sink 930 can be any known or later-developed sink that is capable of storing image data to be marked or capable of marking images based on data output by the input/output interface 810.

Each of the various links 920 and 940 may be any known or later-developed device or system for connecting the data source(s) 910 and/or the data sink(s) 930, respectively, to the input/output interface 810. In particular, the links 920 and 940 my each be implemented as one or more of, for example, a direct cable connection, a connection over a wide area network, a local area network or a storage area network, a connection over an intranet, a connection over an extranet, a connection over the Internet, a connection over any other distributed processing network or system, and/or an infrared, radio-frequency or other wireless connection.

As shown in FIG. 11, the memory 840 may be physically, functionally, and/or conceptually divided into a number of different memory portions, including an alternating number portion 854 and/or a marking data portion 856. The alternating number portion 854 may store the number of sheets that are to be alternated in the output stack of marked combined multi-thickness media. The marking data portion 846 may store input and/or adjusted marking data.

The memory 840 may be implemented using any appropriate combination of alterable or non-alterable memory, volatile or non-volatile memory, or fixed memory. The alterable memory, whether volatile or non-volatile, can be implemented using any one or more of static or dynamic RAM, a floppy disk and disk drive, a writeable or re-re-writeable optical disk and disk drive, a hard drive, flash memory or the like. Similarly, the non-alterable or fixed memory can be implemented using any one or more of ROM, PROM, EPROM, EEPROM, an optical ROM disk, such as CD-ROM or DVD-ROM disk, and disk drive or the like.

The orientation adjusting circuit, routine, or application 850 may input data indicating, for example, the number of sheets that are to be alternated in the output stack and the number of number of sheets of multi thickness media that will be used for a particular marking operation and may adjust the output format accordingly.

For example, in operation, data related to a marking operation may be input from the data source to the input/output interface 810. Under control of the controller 830, the data may be stored in the marking data portion 846 of the memory 840. Alternatively, the marking operation data may be input, under control of the controller 830, directly to the orientation adjusting circuit, routine, or application 850. Under control of the controller 830, the orientation adjusting circuit, routine, or application 850 may access the marking operation data and the data indicating the number of sheets that are to be alternated, and adjust the orientations of the sheets of media in the output data, for example, according to the above described exemplary method. Under control of the controller 830, the adjusted marking operation data may be stored in the marking data portion 846. Alternatively, the adjusted marking data, under control of the controller 830, may be output directly to the data sink 930 via the input/output interface 810.

It should be appreciated that, although the above-described system 800 may input marking data for an entire marking operation. The system 800 may input marking data for each sheet of media individually and adjust the output orientation of the marking data for that sheet, if necessary.

While the exemplary system 800 has been described as physically, functionally, and/or conceptually divided into a controller and an orientation adjusting circuit, routine, or application 850, it should be appreciated that orientation adjusting circuit, routine, or application 850 may be included in and/or executed by the controller 830.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

For example, while the exemplary methods and systems described herein are described within the context of combined multi-thickness media, the methods and systems are applicable to any media that has a thickness variation between its leading edge portion and its trailing edge portion.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of adjusting an output orientation of multi-thickness media, comprising:

inputting marking data;

determining whether the multi-thickness media has been marked;

determining a number of sheets of the multi-thickness media that is to be alternated within an output stack, the multi-thickness media having a first smaller sheet and a second larger sheet, the second sheet having a first end and a second end opposing the first end, the first sheet being attached to the first end of the second sheet; and adjusting the output orientation of at least one sheet of multi-thickness media to be output based on the determined number of sheets of the multi-thickness media to be alternated, and adjusting the output orientation is at least based on whether the multi-thickness media has been marked, such that the first end of the second sheet of the output multi-thickness media is placed on the second end of the second sheet of a previously output multi-thickness media.

2. The method of claim 1, wherein:

adjusting, the output orientation of the at least one sheet of multi-thickness media to be output comprises adjusting the orientation of the at least one sheet such that a thick portion of the at least one sheet is adjacent to a thin portion of a previously output sheet in the output stack.

3. The method of claim 1, wherein:

adjusting the output orientation of at least one sheet of multi-thickness media to be output comprises flipping the sheet over in the output stack.

4. The method of claim 1, wherein:

adjusting the output orientation of the at least one sheet of multi-thickness media to be output comprises rotating the sheet such that a leading edge of the sheet becomes a trailing edge of the sheet.

5. The method of claim 1, wherein:

adjusting the output orientation of the at least one sheet of multi-thickness media to be output comprises adjusting the output orientation of the sheet after the sheet has been marked.

6. The method of claim 1, wherein:

adjusting the output orientation of the at least one sheet of multi-thickness media to be output comprises adjusting the output orientation of the sheet before the sheet has been marked.

7. The method of claim 1, wherein the combined multi-thickness media is thicker in a vicinity of the first sheet of media than in a vicinity of only the second sheet of media.

8. The method of claim 1, wherein:

determining the number of sheets of the multi-thickness media that is to be alternated comprises a user inputting the number of sheets to be alternated.

9. The method of claim 1, wherein:

determining the number of sheets of the multi-thickness media that is to be alternated comprises determining the number of sheets to be alternated based on a total number of sheets in a marking operation.

10. A storage medium storing a set of program instructions executable on a data processing device and usable to adjust an output orientation of multi-thickness media, the instructions comprising:

instructions inputting marking data;

instructions determining whether the multi-thickness media has been marked;

instructions determining a number of sheets of the multi-thickness media that is to be alternated within an output stack, the multi-thickness media having a first smaller sheet and a second larger sheet, the second sheet having a first end and a second end opposing the first end, the first sheet being attached to the first end of the second sheet; and instructions adjusting the output orientation of at least one sheet of multi-thickness media to be output based on the determined number of sheets of the multi-thickness media to be alternated, and adjusting the output orientation is at least based on whether the multi-thickness media has been marked, such that the first end of the second sheet of the output multi-thickness media is placed on the second end of the second sheet of a previously output multi-thickness media.

11. A system for adjusting marking data for use with alternately stacked multi-thickness media, comprising:

a controller that:

inputs marking data;

determines whether the multi-thickness media has been marked:

determines a number of sheets of the multi-thickness media that is to be alternated within an output stack, the multi-thickness media having a first smaller sheet and a second larger sheet, the second sheet having a first end and a second end opposing the first end, the first sheet being attached to the first end of the second sheet; and adjusts the output orientation of at least one sheet of multi-thickness media to be output based on the determined number of sheets of the multi-thickness media to be alternated, and adjusts the output orientation at least based on whether the multi-thickness media has been marked, such that the first end of the second sheet of the output multi-thickness media is placed on the second end of the second sheet of a previously output multi-thickness media.

12. The system of claim 11, wherein the controller:

adjusts the orientation of the at least one sheet such that a thick portion of the at least one sheet is adjacent to a thin portion of a previously output sheet in the output stack.

13. The system of claim 11, wherein the controller:

adjust the orientation of the at least one sheet by at least one of:

flipping the sheet over in the output stack; or rotating the sheet such that a leading edge of the sheet becomes a trailing edge of the sheet.

14. The system of claim 11, wherein the controller:

adjusts the output orientation of the sheet after the sheet has been marked; or adjusts the output orientation of the sheet before the sheet has been marked.

15. The system of claim 11, wherein the combined multi-thickness media is thicker in a vicinity of the first sheet of media than in a vicinity of only the second sheet of media.

16. A xerographic device that xerographically prints an image on a media, comprising the system of claim 11.

17. An inkjet printer that prints an image on a media by injecting ink, comprising the system of claim 11.

18. A laser printer that prints an electro-statically formed image on a media, comprising the system of claim 11.

* * * * *